US007901275B2

(12) United States Patent
Brogden

(10) Patent No.: US 7,901,275 B2
(45) Date of Patent: Mar. 8, 2011

(54) SANDING APPARATUS

(75) Inventor: David S. Brogden, Union, ME (US)

(73) Assignee: Cousin's Abrasives LLC, Rumson, NJ (US)

( * ) Notice: Subject to any disclaimer, the term of this patent is extended or adjusted under 35 U.S.C. 154(b) by 3 days.

(21) Appl. No.: 12/104,903

(22) Filed: Apr. 17, 2008

(65) Prior Publication Data

US 2009/0264058 A1 Oct. 22, 2009

(51) Int. Cl.
*B24D 11/00* (2006.01)

(52) U.S. Cl. ..... 451/526; 451/527

(58) Field of Classification Search ..... 451/526, 451/527

See application file for complete search history.

(56) References Cited

U.S. PATENT DOCUMENTS

| | | | | |
|---|---|---|---|---|
| 5,054,248 | A | 10/1991 | Thayer | |
| 6,227,959 | B1 | 5/2001 | Beaudry | |
| 6,439,988 | B1 | 8/2002 | Long | |
| 6,524,175 | B2 | 2/2003 | Beaudry et al. | |
| 6,626,747 | B1 | 9/2003 | Sidebottom | |
| D497,092 | S | 10/2004 | McCarthy | |
| 6,896,606 | B1 * | 5/2005 | Turgeon et al. | 451/524 |
| 7,364,501 | B2 | 4/2008 | Ali et al. | |
| 2004/0038634 | A1 * | 2/2004 | McCarthy | 451/526 |
| 2004/0043715 | A1 | 3/2004 | Miles | |
| 2004/0092219 | A1 | 5/2004 | Koenig, Jr. | |
| 2007/0298698 | A1 * | 12/2007 | Ali et al. | 451/523 |
| 2008/0207099 | A1 * | 8/2008 | Brown | 451/524 |

OTHER PUBLICATIONS

"Dual Angle Sanding Sponge", found at http://www.tapetechtools.com/dual-angle-sanding..., (1pg).
"3M Corner Sanding Sponge", found at http://www.fantastictools.com/p-454-3m-corner..., (1pg).
"Walls and Dual Angle Sanding Sponge", found at http://paint-and-supplies.hardwarestore.com...(1 pg).
"00941 Dual Angle Sand Sponge", found at http://www.builderdepot.com/seo...(1 pg).
"Sanders and Scrapers, 3M Dual Angle Sanding Sponge", found at http://www.paintpro.net/Articles...(1 pg).

* cited by examiner

*Primary Examiner* — Maurina Rachuba
(74) *Attorney, Agent, or Firm* — Maldjian & Fallon LLC; Jon Fallon, Esq.; John P. Maldjian, Esq.

(57) ABSTRACT

Embodiments of the present invention generally relate to an improved sanding apparatus for minimizing scoring of drywall and other sensitive finishes. In one embodiment of the present invention, a sanding apparatus comprises a flexible, resilient core having a top and bottom sanding surface, a first and second side sanding surface, and a first and second non-sanding surface, each disposed at an angle with respect to the top sanding surface and bottom sanding surface, respectively, and an abrasive aggregate composition disposed on the top sanding surface, bottom sanding surface and the first and second side sanding surfaces, wherein each of the first and second non-sanding surfaces are free of an abrasive aggregate composition.

20 Claims, 2 Drawing Sheets

100

200

SANDING APPARATUS

BACKGROUND OF THE INVENTION

1. Field of the Invention

Embodiments of the present invention generally relate to a sanding apparatus. More specifically, embodiments of the present invention relate to an improved sanding apparatus for minimizing scoring of drywall and other sensitive finishes.

2. Description of the Related Art

Sanding sponges are used extensively in a variety of different applications, including drywalling, woodworking, and metalworking. Standard sanding sponges are generally a substantially rectangular block of material covered on either four or all six sides with an abrasive aggregate composition. An exemplary prior art sanding sponge is shown in FIG. 1. As shown in the Figure, a sanding sponge 100 generally comprises a rectangular block having a core material covered on all four sides with an abrasive material. Optionally, the ends of the rectangular block may also have abrasive material disposed thereon. These standard sanding sponges have a high compressive force resistance, and are thus very rigid, leading to unwanted scoring of drywall or other working surfaces, as well as numerous injuries to hands, fingers, and other sensitive parts of the body.

Well known problems exist with standard sanding sponges when used in corners (i.e., between two perpendicular walls or between a wall and a ceiling). Specifically, abrasive scoring occurs along the outer edge of the sanding sponge, i.e., along the wall. Thus, it is very difficult to achieve an adequately sanded wall or surface using only a standard sanding sponge without resanding the side walls which were scored.

Attempts have been made to create corner sanding sponges, which are designed for overcoming the problems associated with standard sanding sponges when sanding corners. Exemplary corner sanding sponges can be found in United States Patent Application Publication No. 2004/0038634, published Feb. 26, 2004, as well as U.S. Pat. No. 6,439,988, issued Aug. 27, 2002. In each of these references, the sanding sponges disclosed are designed for corner sanding, and adapted for holding and gripping the sponge for performing the same.

However, while these references disclose advantageous corner sanding properties, each of the exemplary embodiments disclosed therein would not be suitable or desirable for flat sanding (i.e., sanding a portion of a wall distal from a corner). Particularly, the very limited surface area on any one given face of the respective sanding sponge would make flat sanding burdensome and time consuming. Furthermore, at times the opposing faces of these existing sanding sponges are not aligned with one another (i.e., one face is offset from its opposing face), such that when pressure is applied in the center of one side of the sanding sponge, it may not applied to the center of its opposite side causing uneven force about the flat surface. Thus, a person would be required to carry corner sanding sponges and standard sanding sponges in order to efficiently and satisfactorily finish sanding projects.

Therefore, there is a need in the industry for an improved sanding apparatus designed for both flat and corner sanding while overcoming the deficiencies extant in the prior art.

SUMMARY OF THE INVENTION

Embodiments of the present invention generally relate to an improved sanding apparatus for minimizing scoring of drywall and other sensitive finishes. In one embodiment of the present invention, a sanding apparatus comprises a flexible, resilient core having a top and bottom sanding surface, a first and second side sanding surface, and a first and second non-sanding surface, each disposed at an angle with respect to the top sanding surface and bottom sanding surface, respectively, and an abrasive aggregate composition disposed on the top sanding surface, bottom sanding surface and the first and second side sanding surfaces, wherein each of the first and second non-sanding surfaces are free of an abrasive aggregate composition.

In another embodiment of the present invention, a sanding apparatus comprises a flexible, resilient core having a top and bottom sanding surface, a first and second side sanding surface, and a first and second non-sanding surface, disposed at an angle with respect to the top sanding surface and bottom sanding surface, respectively, whereby each non-sanding surface is free of an abrasive aggregate composition, and an abrasive aggregate composition disposed on the top sanding surface, bottom sanding surface and the first and second side sanding surfaces, comprising at least one of garnet, emery, aluminum oxide, silicon carbide, alumina-zirconia, chromium oxide, calcium carbonate, diamond dust, pumice dust, novaculite, sand, silica, iron oxide, ceramic, or borazon, wherein the angle of the first non-sanding surface is between about 35° to about 70° with respect to the top sanding surface, and wherein the angle of the second non-sanding surface is between about 35° to about 70° with respect to the bottom sanding surface.

In yet another embodiment, a method of sanding a wall comprises providing a sanding apparatus having a flexible, resilient core having a top and bottom sanding surface, a first and second side sanding surface, and a first and second non-sanding surface, each disposed at an angle with respect to the top sanding surface and bottom sanding surface, respectively, and an abrasive aggregate composition disposed on the top sanding surface, bottom sanding surface and the first and second side sanding surfaces, wherein each of the first and second non-sanding surfaces are free of an abrasive aggregate composition; applying a compressing force on at least one of the top or bottom sanding surface; and moving the sanding apparatus across a surface of the wall, while applying the compressive force thereon.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
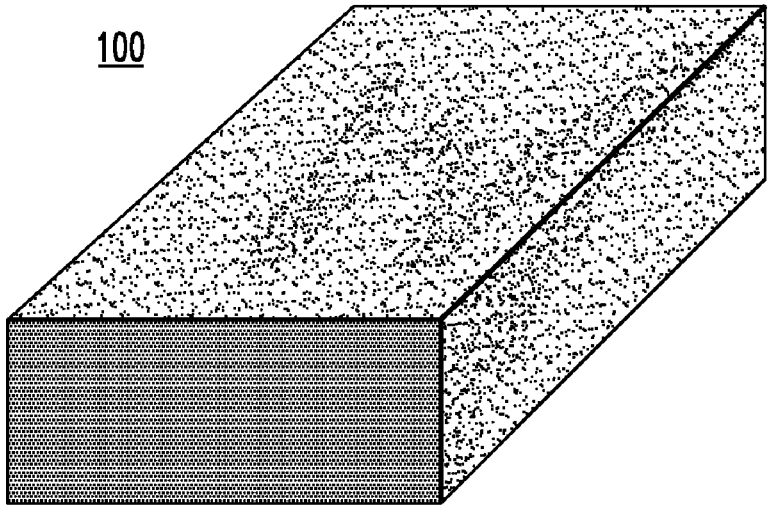
FIG. 1 PRIOR ART
FIG. 1 depicts a perspective view of an exemplary prior art sanding sponge.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION OF THE INVENTION

Embodiments of the present invention generally relate to a sanding apparatus. More specifically, embodiments of the present invention relate to a sanding apparatus having two opposing edges removed and free of aggregate to minimize scoring of drywall and other sensitive finishes.

Figure 2:
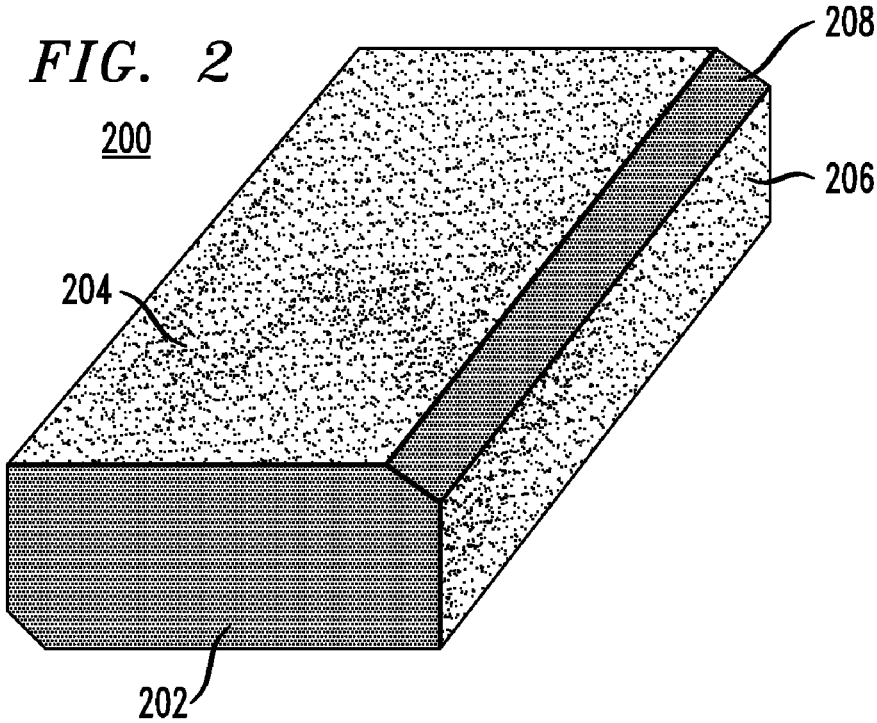
FIG. 2 depicts a perspective view of a sanding apparatus in accordance with one embodiment of the present invention.
Figure 3:
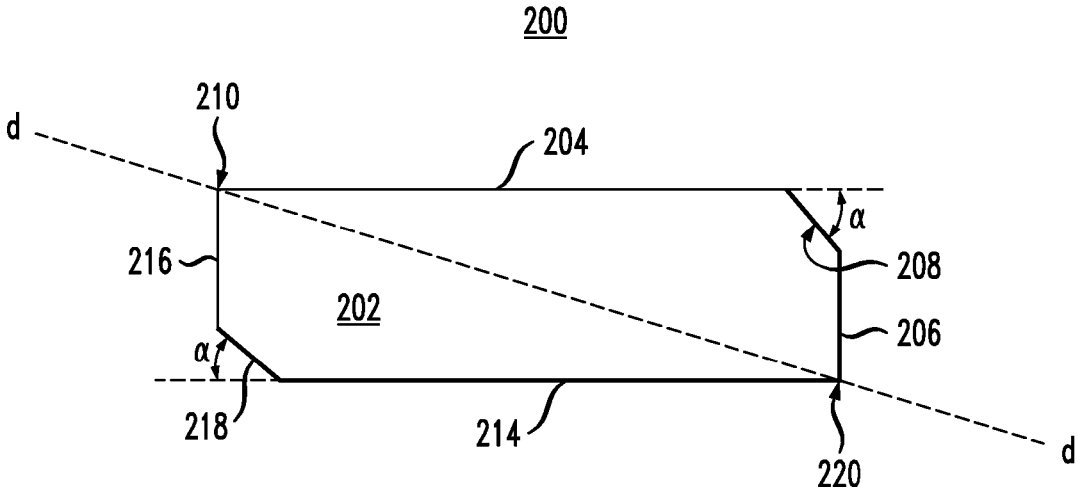
FIG. 3 depicts a cross-sectional view of the sanding apparatus of FIG. 2.

FIG. 2 depicts a perspective view of a sanding apparatus in accordance with one embodiment of the present invention, a cross-section of which is depicted in FIG. 3. Generally, a sanding apparatus 200 comprises at least a flexible, resilient core 202, having a top sanding surface 204, a first side sanding surface 206, and a first non-sanding surface 208. In many embodiments, the sanding apparatus additionally comprises a second bottom sanding surface 214, a second side sanding surface 216, and a second non-sanding surface 218, all of which are mirrored about a diagonal plane passing through the entire length of the sanding apparatus 200, as shown in FIG. 3, as axis d-d. The sanding apparatus 200 also comprises a first end and a second end, generally defined by a plane of the flexible, resilient core substantially perpendicular to each of surfaces of the sanding apparatus. It is understood by embodiments of the present invention, any reference to a single surface may apply to the single surface, its mirrored surface, or both.

The core 202 generally comprises a flexible, resilient material, capable of conforming slightly to the hand of a user. The core 202 is also generally able to withstand moderate compressive forces, such as those experienced by the sanding apparatus during drywalling and woodworking applications. In one embodiment of the present invention, the core 202 comprises either open-celled or closed-celled foamed polymeric material, for example, open-celled urethane-based foam, or the like. The sanding apparatus 200 also comprises a first end and a second end. The ends of the sanding apparatus Each of the top sanding surfaces 204 and side sanding surfaces 206 generally comprise an abrasive aggregate disposed on the respective surfaces by way of adhesive or other means for attachment. In one embodiment, the abrasive aggregate comprise at least one of garnet, emery, aluminum oxide, silicon carbide, alumina-zirconia, chromium oxide, calcium carbonate, diamond dust, pumice dust, novaculite, sand, silica, iron oxide, ceramic, borazon, or the like. In alternative embodiments, the abrasive aggregate comprises at least one of the abrasive particles disclosed by U.S. Pat. No. 6,059,850, the disclosure of which is incorporated by reference herein.

The abrasive aggregate may be applied to any surface, in particular, the top sanding surface 204 and side sanding surface 206, by any means suitable for embodiments of the present invention. In one embodiment, the abrasive aggregate is applied by applying a liquid adhesive over a surface, coating the liquid adhesive layer with the abrasive aggregate composition, and then drying the adhesive. In many embodiments, where open-celled polymers are utilized as the core 202, the liquid adhesive may be substantially wicked into the core 202, leaving only a thin adhesive meniscus around the abrasive aggregate particles, resulting in a more abrasive surface roughness.

The abrasive aggregate generally comprises any suitable abrasive particles having a median particle diameter from about 1 micron to about 600 microns (2000 to 30 grit). In one embodiment of the present invention, the top sanding surface 204 and side sanding surface 206 of the sanding apparatus 200 comprise abrasive aggregate particles of substantially uniform size. Optionally, in such an embodiment, the second sanding surface and second side sanding surface may comprise abrasive aggregate particles of either the same uniform size, or of a different size (and resulting grit), so as to differentiate between a fine grit pair of surfaces and a coarse grit pair of surfaces.

FIG. 3 depicts a cross-sectional view of the sanding apparatus of FIG. 2. In one embodiment of the present invention, a sanding apparatus 200 comprises a six-sided structure, cross-sectionally mirrored about an axis d-d, passing through two ninety degree edges 210, 220. In such an embodiment, the first non-sanding surface 208 and the second non-sanding surface 218 are disposed at an angle $\alpha$ with respect to the top sanding surface 204 and bottom sanding surface 214, respectively. In alternative embodiments of the present invention, the angle of the first non-sanding surface and second non-sanding surface may be different from one another.

In many embodiments of the present invention, the angle $\alpha$ is between about 35° and about 70°. In other embodiments, the angle $\alpha$ is between about 40° and about 50°, and in another embodiment, the angle $\alpha$ is about 45°.

The sanding apparatus 200 may be dimensions suitable for embodiments of the present invention. In accordance with many embodiments, the size of the first and second non-sanding surfaces 208 and 218 is dependent upon the angle $\alpha$, as discussed supra, as well as the height of side sanding surfaces 206 and 216, respectively. In one exemplary embodiment, the sanding apparatus 200 may have a width (from side sanding surface 206 to side sanding surface 216) of about 3 inches, a length (from first end to second end) of about 4 inches, and a thickness or height (from top sanding surface 204 to bottom sanding surface 214) of about one inch. In such an exemplary embodiment, the height of side sanding surfaces 206 and 216 may range from between about 1/32 inch (about 0.03125 inch) to about 31/32 inch (about 0.96875). In another exemplary embodiment, the height of side sanding surfaces 206 and 216 may range from between about 1/4 inch (about 0.25 inch) to about 3/4 inch (about 0.75). Some alternative embodiments of the present invention provide although the overall dimensions of the sanding apparatus 200 may vary as necessary, the general size ratios between respective surfaces is generally maintained.

In use, embodiments of the present invention may be utilized to ideally sand a surface, as well as corners, without causing undesirable scoring. In one embodiment, in order to sand a corner, the ninety degree edge 220 is positioned along the corner (i.e., positioned against the intersection of two walls, or wall and ceiling). A compressive force is placed on the top sanding surface 204. At the same time, the sanding apparatus 200 is moved in a direction along the corner such that the ninety degree edge 220 remains aligned against the corner throughout the process. Upon completion, the resulting corner is smoothly sanded, and the adjacent surface remains unscored.

Furthermore, the sanding apparatus 200 may be utilized to advantageously sand a general surface (i.e., the center portion of a wall). In one embodiment, the bottom sanding surface 214 is placed against the surface to be sanded as a compressive force is placed on the top sanding surface. The sanding apparatus 200 is then moved along the surface, either in rotational, vertical, horizontal, or random direction, in order to smoothly sand the surface without causing undesirable scoring.

While the foregoing is directed to embodiments of the present invention, other and further embodiments of the invention may be devised without departing from the basic scope thereof.

What is claimed is:

1. A combination flat surface and corner sanding apparatus consisting of:

a flexible, resilient core having a top and bottom sanding surface, a first and second side sanding surface, each disposed at a right angle to the top sanding surface and the bottom sanding surface, respectively, and a first and second non-sanding surface, each disposed at an angle with respect to the top sanding surface and bottom sanding surface, respectively; and an abrasive aggregate composition disposed on the top sanding surface, bottom sanding surface and the first and second side sanding surfaces;

wherein each of the first and second non-sanding surfaces are free of an abrasive aggregate composition, the combination flat surface and corner sanding apparatus having a width to height ratio of about 3:1, and a height of about one inch or less; and wherein the combination flat surface and corner sanding apparatus is capable of sanding a surface of a first wall, a surface of a second wall positioned perpendicular to the first wall, and a corner defined by an intersecting edge of the first wall and the second wall, and wherein substantially no scoring occurs along a trail edge of the top sanding surface on the first wall, and substantially no scoring occurs along a trail edge of a first side sanding surface on the second wall.

2. The combination flat surface and corner sanding apparatus of claim 1, wherein the core comprises a polymeric material.

3. The combination flat surface and corner sanding apparatus of claim 2, wherein the core comprises an open-celled urethane-based foam.

4. The combination flat surface and corner sanding apparatus of claim 1, wherein the abrasive aggregate composition comprises at least one of garnet, emery, aluminum oxide, silicon carbide, alumina-zirconia, chromium oxide, calcium carbonate, diamond dust, pumice dust, novaculite, sand, silica, iron oxide, ceramic, or borazon.

5. The combination flat surface and corner sanding apparatus of claim 1, wherein the angle of the first non-sanding surface is between about 35° to about 70° with respect to the top sanding surface.

6. The combination flat surface and corner sanding apparatus of claim 5, wherein the angle of the second non-sanding surface is between about 35° to about 70° with respect to the bottom sanding surface.

7. The combination flat surface and corner sanding apparatus of claim 5, wherein the angle of the first non-sanding surface is between about 40° to about 50° with respect to the top sanding surface.

8. The combination flat surface and corner sanding apparatus of claim 7, wherein the angle of the first non-sanding surface is about 45° with respect to the top sanding surface.

9. The combination flat surface and corner sanding apparatus of claim 1, wherein the abrasive aggregate composition comprises particles having a median particle diameter from about 1 micron to about 600 microns.

10. The combination flat surface and corner sanding apparatus of claim 9, wherein the abrasive aggregate composition comprises particles having substantially uniform particle size disposed on all applicable sanding surfaces of the sanding apparatus.

11. The combination flat surface and corner sanding apparatus of claim 9, wherein the top sanding surface and first side sanding surface comprise an abrasive aggregate composition having a first particle size, and wherein the bottom sanding surface and second side sanding surface comprise an abrasive aggregate composition having a second particle size.

12. A combination flat surface and corner sanding apparatus consisting of:

a flexible, resilient core having:

a top and bottom sanding surface, a first and second side sanding surface, each disposed at a right angle to the top sanding surface and the bottom sanding surface, respectively, and a first and second non-sanding surface, disposed at an angle with respect to the top sanding surface and bottom sanding surface, respectively, whereby each non-sanding surface is free of an abrasive aggregate composition; and an abrasive aggregate composition disposed on the top sanding surface, bottom sanding surface and the first and second side sanding surfaces, comprising at least one of garnet, emery, aluminum oxide, silicon carbide, alumina-zirconia, chromium oxide, calcium carbonate, diamond dust, pumice dust, novaculite, sand, silica, iron oxide, ceramic, or borazon;

wherein the angle of the first non-sanding surface is between about 35° to about 70° with respect to the top sanding surface, and wherein the angle of the second non-sanding surface is between about 35° to about 70° with respect to the bottom sanding surface, the combination flat surface and corner sanding apparatus having a width to height ratio of about 3:1, and a height of about one inch or less; and wherein the combination flat surface and corner sanding apparatus is capable of sanding a surface of a first wall, a surface of a second wall positioned perpendicular to the first wall, and a corner defined by an intersecting edge of the first wall and the second wall, and wherein substantially no scoring occurs along a trail edge of the top sanding surface on the first wall, and substantially no scoring occurs along a trail edge of a first side sanding surface on the second wall.

13. The combination flat surface and corner sanding apparatus of claim 12, wherein the angle of the first non-sanding surface is between about 40° to about 50° with respect to the top sanding surface.

14. The combination flat surface and corner sanding apparatus of claim 13, wherein the angle of the first non-sanding surface is about 45° with respect to the top sanding surface.

15. The combination flat surface and corner sanding apparatus of claim 12, wherein the abrasive aggregate composition comprises particles having a median particle diameter from about 1 micron to about 600 microns.

16. The combination flat surface and corner sanding apparatus of claim 15 wherein the abrasive aggregate composition comprises particles having substantially uniform particle size disposed on all applicable sanding surfaces of the sanding apparatus.

17. The combination flat surface and corner sanding apparatus of claim 15, wherein the top sanding surface and first side sanding surface comprise an abrasive aggregate composition having a first particle size, and wherein the bottom sanding surface and second side sanding surface comprise an abrasive aggregate composition having a second particle size.

18. A combination flat surface and corner sanding apparatus consisting of:

a flexible, resilient core having a top and bottom sanding surface, a first and second side sanding surface, each disposed at a right angle to the top sanding surface and the bottom sanding surface, respectively, and a first and second non-sanding surface, each disposed at between a 35 to 70 degree angle with respect to the top sanding surface and bottom sanding surface, respectively; and an abrasive aggregate composition disposed on the top sanding surface, bottom sanding surface and the first and second side sanding surfaces;

wherein each of the first and second non-sanding surfaces are free of an abrasive aggregate composition, the combination flat surface and corner sanding apparatus having a width to height ratio of about 3:1, and a height of about one inch; and wherein the combination flat surface and corner sanding apparatus is capable of sanding a surface of a first wall, a surface of a second wall positioned perpendicular to the first wall, and a corner defined by an intersecting edge of the first wall and the second wall, and wherein substantially no scoring occurs along a trail edge of the top sanding surface on the first wall, and substantially no scoring occurs along a trail edge of a first side sanding surface on the second wall.

19. The combination flat surface and corner sanding apparatus of claim 18, wherein the core comprises a polymeric material.

20. The combination flat surface and corner sanding apparatus of claim 18, wherein the abrasive aggregate composition comprises at least one of garnet, emery, aluminum oxide, silicon carbide, alumina-zirconia, chromium oxide, calcium carbonate, diamond dust, pumice dust, novaculite, sand, silica, iron oxide, ceramic, or borazon.

* * * * *